US012281838B2

(12) United States Patent
Alves Ferreira et al.

(10) Patent No.: US 12,281,838 B2
(45) Date of Patent: Apr. 22, 2025

(54) REFRIGERATOR APPLIANCE

(71) Applicant: WHIRLPOOL CORPORATION, Benton Harbor, MI (US)

(72) Inventors: Luiz Afranio Alves Ferreira, Joinville (BR); Marcel Bögger Lessa, Joinville (BR); Gustavo Spezzia, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 161 days.

(21) Appl. No.: 18/330,796

(22) Filed: Jun. 7, 2023

(65) Prior Publication Data

US 2024/0410640 A1 Dec. 12, 2024

(51) Int. Cl.
*F25D 23/02* (2006.01)

(52) U.S. Cl.
CPC ..... *F25D 23/028* (2013.01)

(58) Field of Classification Search
CPC ..... F25D 23/028
See application file for complete search history.

(56) References Cited

U.S. PATENT DOCUMENTS

| | | | | |
|---|---|---|---|---|
| 7,549,300 | B2 | 6/2009 | Chun et al. | |
| 10,386,111 | B2 * | 8/2019 | Akca | E05B 17/0033 |
| 11,112,165 | B2 * | 9/2021 | Heckler | F25D 23/028 |
| 11,175,088 | B2 * | 11/2021 | Guelmez | F25D 21/04 |
| 11,236,938 | B2 * | 2/2022 | Yang | F25D 23/10 |
| 2021/0140702 | A1 * | 5/2021 | Park | E05F 15/619 |
| 2022/0316789 | A1 * | 10/2022 | Kumar | F25D 23/003 |

FOREIGN PATENT DOCUMENTS

| | | | |
|---|---|---|---|
| CN | 215447011 | U | 1/2022 |
| KR | 20100062019 | A | 6/2010 |
| KR | 102351995 | B1 * | 1/2022 |
| KR | 20230027666 | A * | 2/2023 |

* cited by examiner

*Primary Examiner* — Hanh V Tran
(74) *Attorney, Agent, or Firm* — Brooks Kushman P.C.

(57) ABSTRACT

A refrigerator includes a cabinet, a door, and a partition. The cabinet defines an air inlet and an air outlet. The door is movably secured to the cabinet. The door is configured to transition between open and closed positions. The partition is movably secured to the door. The partition is configured to advance away from the door to transition to an operational position. The partition is configured to retract toward the door to transition to a stowed position. In response to closing the door, the partition transitions to the operational position and engages the cabinet to separate the air inlet from the air outlet. In response to opening the door, the partition transitions to the stowed position and provides clearance within a space that is defined between the door and the cabinet when the door is in the open position.

20 Claims, 4 Drawing Sheets

REFRIGERATOR APPLIANCE

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator includes a cabinet, a door, and a divider. The cabinet defines a refrigerated compartment, a machine compartment below the refrigerated compartment, an inlet to the machine compartment, and an outlet from the machine compartment. The door is rotatably secured to the cabinet. The door is configured to rotate to an open position to provide access to the refrigerated compartment. The door is configured to rotate to a closed position to cover the refrigerated compartment. The divider is rotatably secured to a bottom of the door. The divider is configured to rotate to an advanced position in response to closing the door. The divider is configured to rotate to a retracted position in response to opening the door. In the advanced position, the divider is rotated away from the bottom of the door and engages a lower end of the cabinet to separate the inlet from the outlet. In the retracted position, the divider is rotated toward the bottom of the door to provide clearance for a user within a space that is defined between the door and the cabinet when the door is in the open position.

A refrigerator includes a cabinet, a door, and a divider plate. The cabinet defines an air inlet and an air outlet. The door is movably secured to the cabinet. The door is configured to transition between open and closed positions. The divider plate is movably secured to the door. The divider plate is configured to advance away from the door to transition to a first position. The dividers plate is configured to retract toward the door to transition to a second position. In response to closing the door, the divider plate advances away from the door, transitions to the first position, and engages the cabinet to separate the air inlet from the air outlet. In response to opening the door, the divider plate retracts toward the door, transitions to the second position, and provides clearance within a space that is defined between the door and the cabinet when the door is in the open position.

A refrigerator includes a cabinet, a door, and a partition. The cabinet defines an air inlet and an air outlet. The door is movably secured to the cabinet. The door is configured to transition between open and closed positions. The partition is movably secured to the door. The partition is configured to advance away from the door to transition to an operational position that is substantially perpendicular to the door. The partition is configured to retract toward the door to transition to a stowed position that is substantially parallel to the door. In response to closing the door, the partition transitions to the operational position and engages the cabinet to separate the air inlet from the air outlet. In response to opening the door, the partition transitions to the stowed position and provides clearance within a space that is defined between the door and the cabinet when the door is in the open position.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
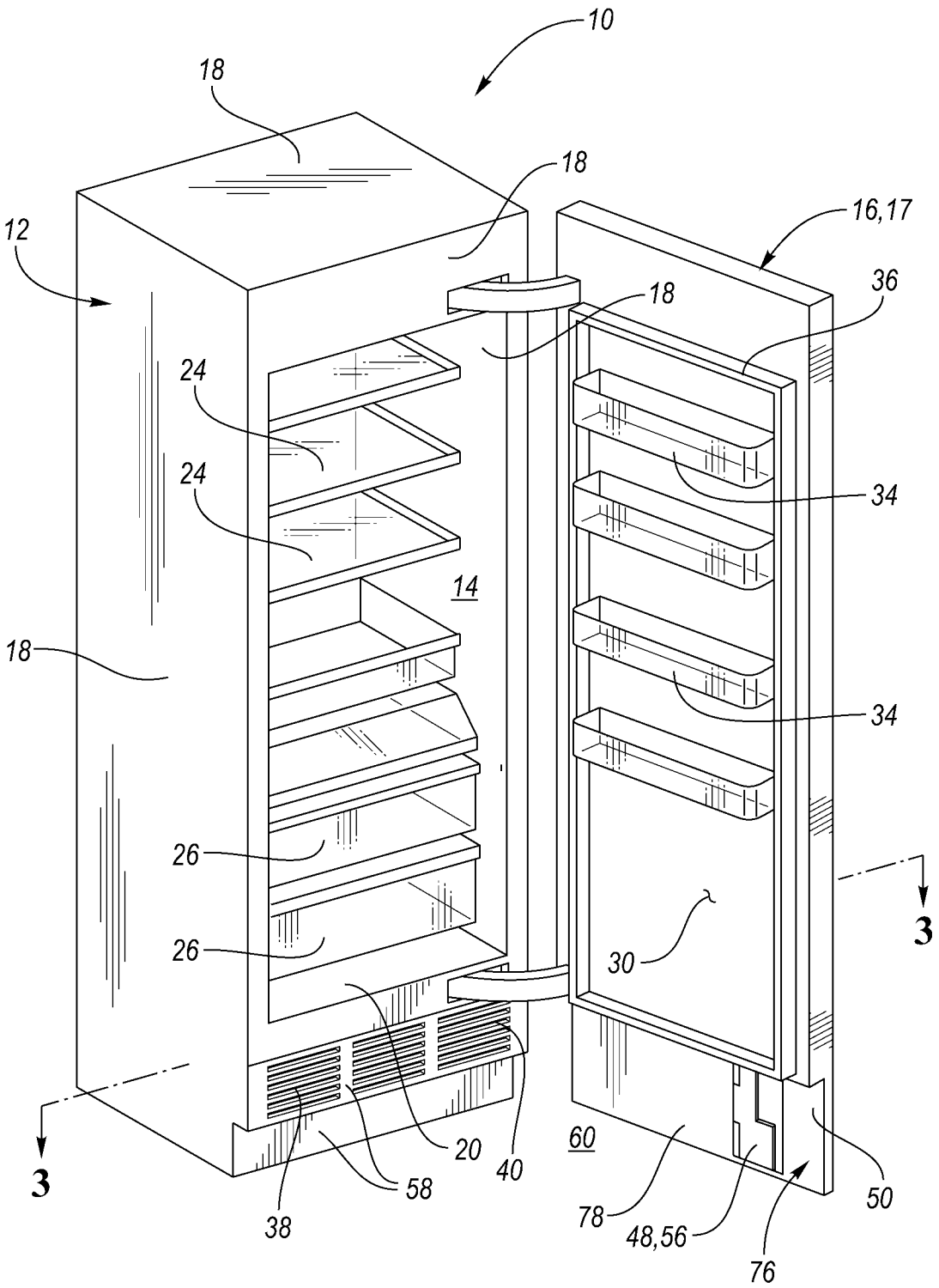
FIG. 1 is an isometric front view of a refrigerator with a refrigerator compartment door open.
Figure 2:
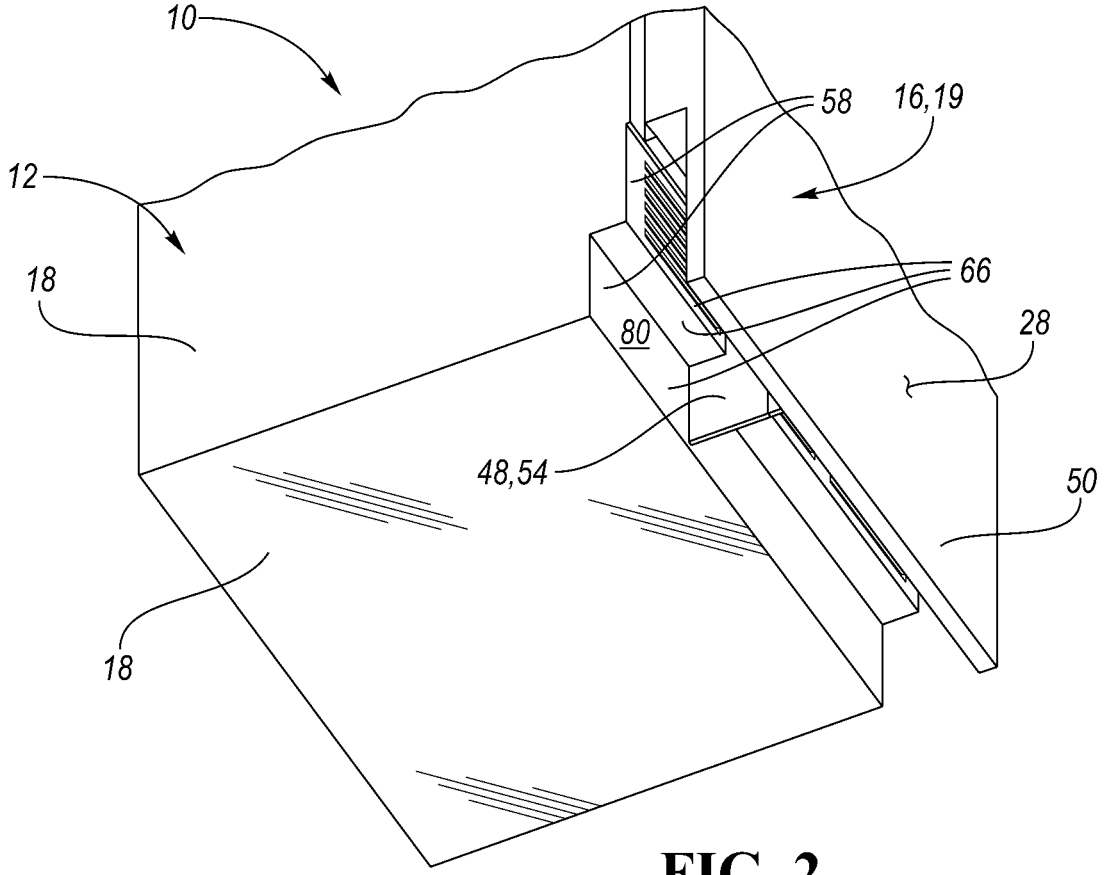
FIG. 2 is a partial isometric bottom view of the refrigerator.
Figure 3:
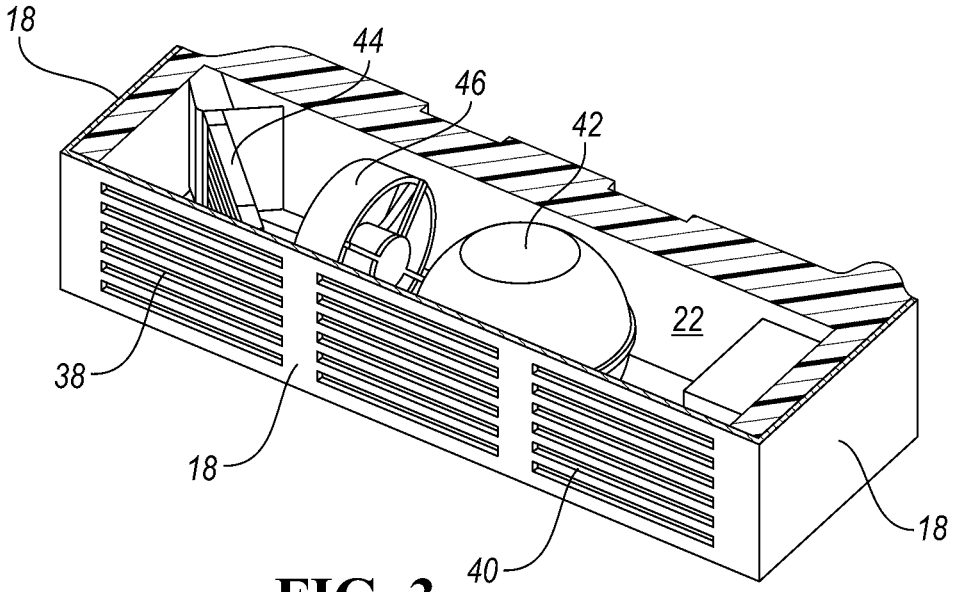
FIG. 3 is a partial cross-sectional view taken along line 3-3 in FIG. 1 illustrating a machine compartment of the refrigerator.

Referring to FIGS. 1-3, generally a refrigerator 10 having a single refrigerated compartment is illustrated. However, it should be understood that this disclosure could apply to any type of refrigerator appliance, such as refrigerator having two compartments (e.g., a refrigerated compartment and a freezer compartment), a side-by-side, two-door bottom mount, a top-mount type, or French-Door Bottom Mount type. As shown in FIGS. 1 and 2, the refrigerator 10 may have a housing or cabinet 12 defining a refrigerated compartment or internal storage chamber 14 that is either (i) configured to refrigerate and not freeze consumables within the internal storage chamber 14 (e.g., the internal storage chamber 14 may be a fresh food compartment) or (ii) configured to freeze consumables within the internal storage chamber 14 during normal use (e.g., the internal storage chamber 14 may be a freezer compartment).

The refrigerator 10 may have a door 16 that provides selective access to the interior volume of the refrigerator 10 where consumables may be stored (i.e., the internal storage chamber 14). The door 16 may be movably secured to the cabinet 12. More specifically, the door 16 may be rotatably secured to the cabinet 12 of the refrigerator 10 by one or more hinges. The door 16 is configured to transition between an open position 17 and a closed position 19. More specifically, the door 16 may be configured to rotate to the open position 17 to provide access to the internal storage chamber 14 and may be configured to rotate to the closed position 19 to cover the internal storage chamber 14.

If the internal storage chamber 14 is a freezer compartment it may be typically kept at a temperature below the freezing point of water. If the internal storage chamber 14 is a fresh food compartment it may be typically kept at a temperature above the freezing point of water and generally below a temperature of from about 35° F. to about 50° F., more typically below about 38° F.

The refrigerator 10 includes panels or walls 18 that form the cabinet 12 and define the internal storage chamber 14. The walls 18 may more specifically form an inner or internal liner of the refrigerator 10. The walls 18 may include a rear or back wall, a front wall, a top wall, a bottom wall, and two side walls. The walls 18 may also include additional internal walls, such as a divider wall 20 between internal storage chamber 14 and a machine compartment 22. The walls 18 may include both exterior panels and interior panels. The interior panels may form the inner liner and the exterior panels may form the exterior of the cabinet 12. An insulating material, such as an insulating foam, may be disposed between the exterior panels and the interior panels.

One or more shelves 24 may be secured to the walls 18 within the internal storage chamber 14. One or more drawers 26 may be slidably secured to the shelves 24 or the walls 18 within the internal storage chamber 14. More specifically, the drawers 26 may be slidably secured to the shelves 24 or the walls 18 within the internal storage chamber 14 via tracks or rails. One or more of the drawers 26 may be either a pantry drawer or a crisper drawer. Crisper drawers may more specifically be drawers defining a storage space that is kept at a desired humidity that may be different from the remainder of the internal storage chamber 14, but that is optimal for maintaining freshness of fruits and vegetables.

The door 16 may include an exterior panel 28 and an interior panel 30 that is disposed on an internal side of the exterior panel 28 of the door 16. The interior panel 30 may be configured to face the internal storage chamber 14 when the door 16 is in a closed position 19. The interior panel 30 may more specifically be a door liner. An insulating material, such as an insulating foam, may be disposed between the exterior panel 28 and interior panel 30 of the door 16 in order reduce the heat transfer from the ambient surroundings and increase the efficiency of the refrigerator.

The door 16 may also include storage bins 34 that are able to hold smaller food items or containers. The storage bins 34 may be secured to the interior panel 30 of the door 16. Alternatively, the storage bins 34 may integrally formed within or defined by the interior panel 30 of the door 16. In yet another alternative, a portion of the storage bins 34 may be secured to the interior panel 30 of the door 16, while another portion of the storage bins 34 may be integrally formed within or defined by the interior panel 30 of the door 16. The storage bins 34 may include shelves (e.g., a lower surface upon, which a food item or container may rest upon) that extend from the interior panel 30 of the door 16.

The machine compartment 22 is defined below the divider wall 20 (e.g., on an opposing side of the divider wall 20 relative to the internal storage chamber 14) and within the walls 18 of the cabinet 12 (e.g., the walls 18 of the cabinet 12 form an outer boundary around the machine compartment 22). A first of the walls 18 (e.g., the front wall 18 of the cabinet 12) defines an opening to the internal storage chamber 14. A gasket seal 36 that is disposed on the door 16 is configured to engage the first of the walls 18 to form a seal around the internal storage chamber 14 to prevent cooled air from escaping the internal storage chamber 14 when the door 16 is the in the closed position 19.

The first of the walls 18 may define an air inlet 38 to the machine compartment 22 and may define an air outlet 40 from the machine compartment 22. Alternatively, the air inlet 38 and air outlet 40 may be defined on a cover or plate that is secured to the first of the walls 18. A compressor 42, a condenser 44, and an air circulation fan 46 may each be disposed within the machine compartment 22. In order to properly cool the internal storage chamber 14 of the refrigerator 10, heat needs to be rejected from the compressor 42 and condenser 44 to the ambient surroundings. This is accomplished by drawing air into the machine compartment 22 through the air inlet 38, across the compressor 42 and condenser 44, and out of the air outlet 40. The circulation fan 46 provides the driving force to move the air through the machine compartment 22. The airflow into the machine compartment 22 via the air inlet 38 may be referred to as the cold air intake flow path. The airflow out of the machine compartment 22 via the air outlet 40 may be referred to as the hot air exhaust flow path.

The refrigerator 10 may also have a control board or controller that sends electrical signals to various components of the refrigerator 10 to control the various components of the refrigerator 10. For example, the controller may control or adjust the cooling operation of the refrigerator 10 by adjusting the output of the compressor 42, which in turns controls or adjusts the flow rate of a refrigerant that is used to cool the internal storage chamber 14. The controller may also control the rate of heat exchange from the compressor 42 and condenser 44 to the air flowing through the machine compartment 22 by adjusting the speed of the air circulation fan 46.

Such a controller may be part of a larger control system and may be controlled by various other controllers throughout the refrigerator 10, and one or more other controllers can collectively be referred to as a "controller" that controls various functions of the refrigerator 10 in response to inputs or signals to control functions of the refrigerator 10. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the refrigerator 10.

Control logic or functions performed by the controller may be represented by flow charts or similar diagrams in one or more figures. These figures provide representative control strategies and/or logic that may be implemented using one or more processing strategies such as event-driven, interrupt-driven, multi-tasking, multi-threading, and the like. As such, various steps or functions illustrated may be performed in the sequence illustrated, in parallel, or in some cases omitted. Although not always explicitly illustrated, one of ordinary skill in the art will recognize that one or more of the illustrated steps or functions may be repeatedly performed depending upon the particular processing strategy being used. Similarly, the order of processing is not necessarily required to achieve the features and advantages described herein, but is provided for case of illustration and description. The control logic may be implemented primarily in software executed by a microprocessor-based controller. Of course, the control logic may be implemented in software, hardware, or a combination of software and hardware in one or more controllers depending upon the particular application. When implemented in software, the control logic may be provided in one or more computer-readable storage devices or media having stored data representing code or instructions executed by a computer to control the refrigerator 10 or its subsystems. The computer-readable storage devices or media may include one or more of a number of known physical devices which utilize electric, magnetic, and/or optical storage to keep executable instructions and associated calibration information, operating variables, and the like.

A portion of the hot air exhaust flow path could be directed into the air inlet 38 due to the proximity of the air inlet 38 to the air outlet 40. Directing the hot air from the exhaust flow path back into the machine compartment 22 will decrease the amount heat being rejected from the compressor 42 and condenser 44, which reduces the efficiency of the refrigeration process to maintain a desirable cool temperature with the internal storage chamber 14. Therefore, it is desirable to prevent the air from the hot air exhaust flow path from be directed into to the air inlet 38.

Referring to FIGS. 1-5, a divider 48 that is configured to segregate the cold air intake flow path (i.e., the air flowing into the machine compartment 22 via the air inlet 38) from the hot air exhaust flow path (i.e., the air flowing out of the machine compartment 22 via the air outlet 40) is illustrated in further detail. The divider 48 may also be referred to as a divider plate, partition, partition plate, or partition wall. The divider 48 is movably secured to the door 16. More specifically, the divider 48 may be rotatably secured to a lower end or bottom 50 of the door 16. One or more pivot pins 52 may be utilized to secure the divider 48 to the door 16. The divider 48 may be configured to rotate about the one or more pivot pins 52.

Figure 4A:
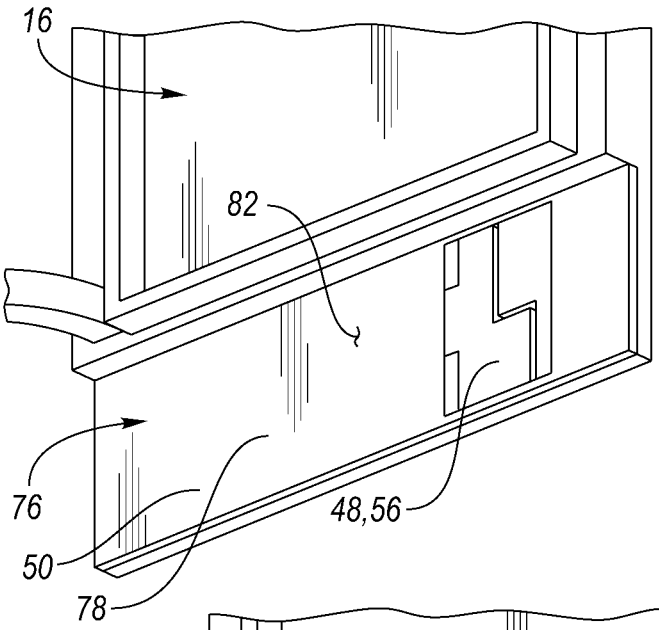
FIGS. 4A-4C are partial isometric rear views of the refrigerator compartment door illustrating a divider transitioning between retracted and advanced positions.
Figure 4B:
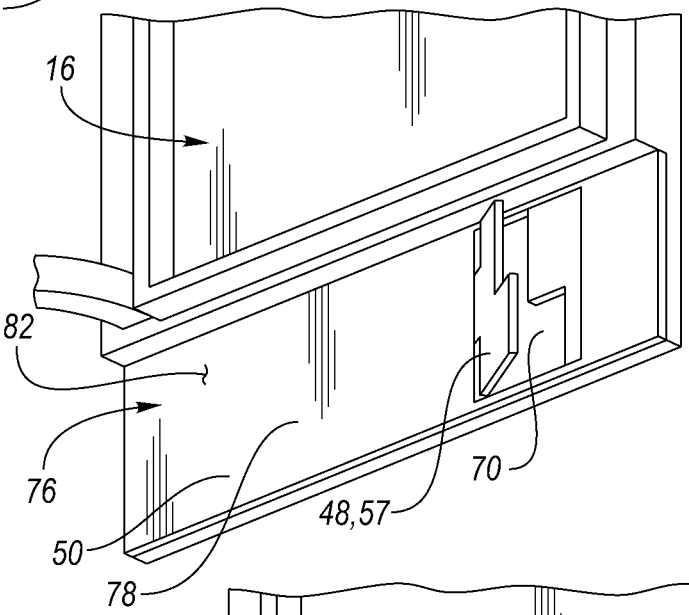
Figure 4C:
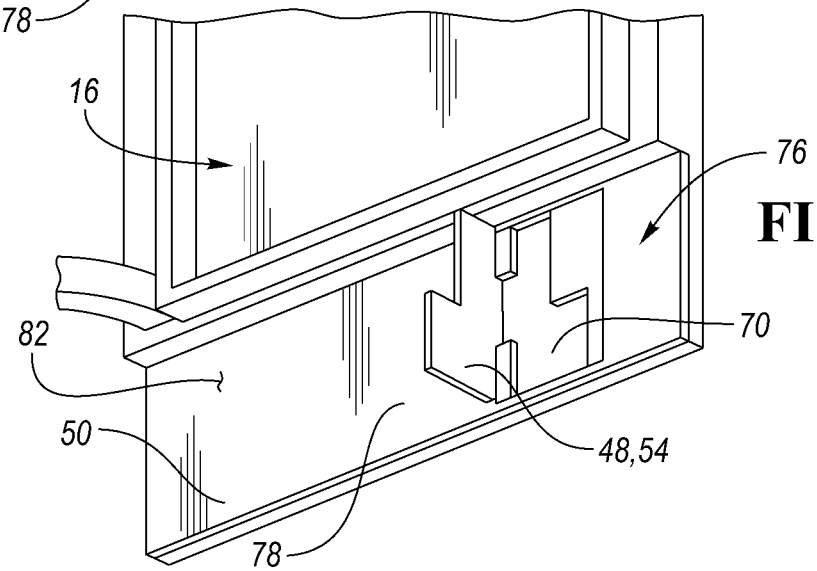
Figure 5:
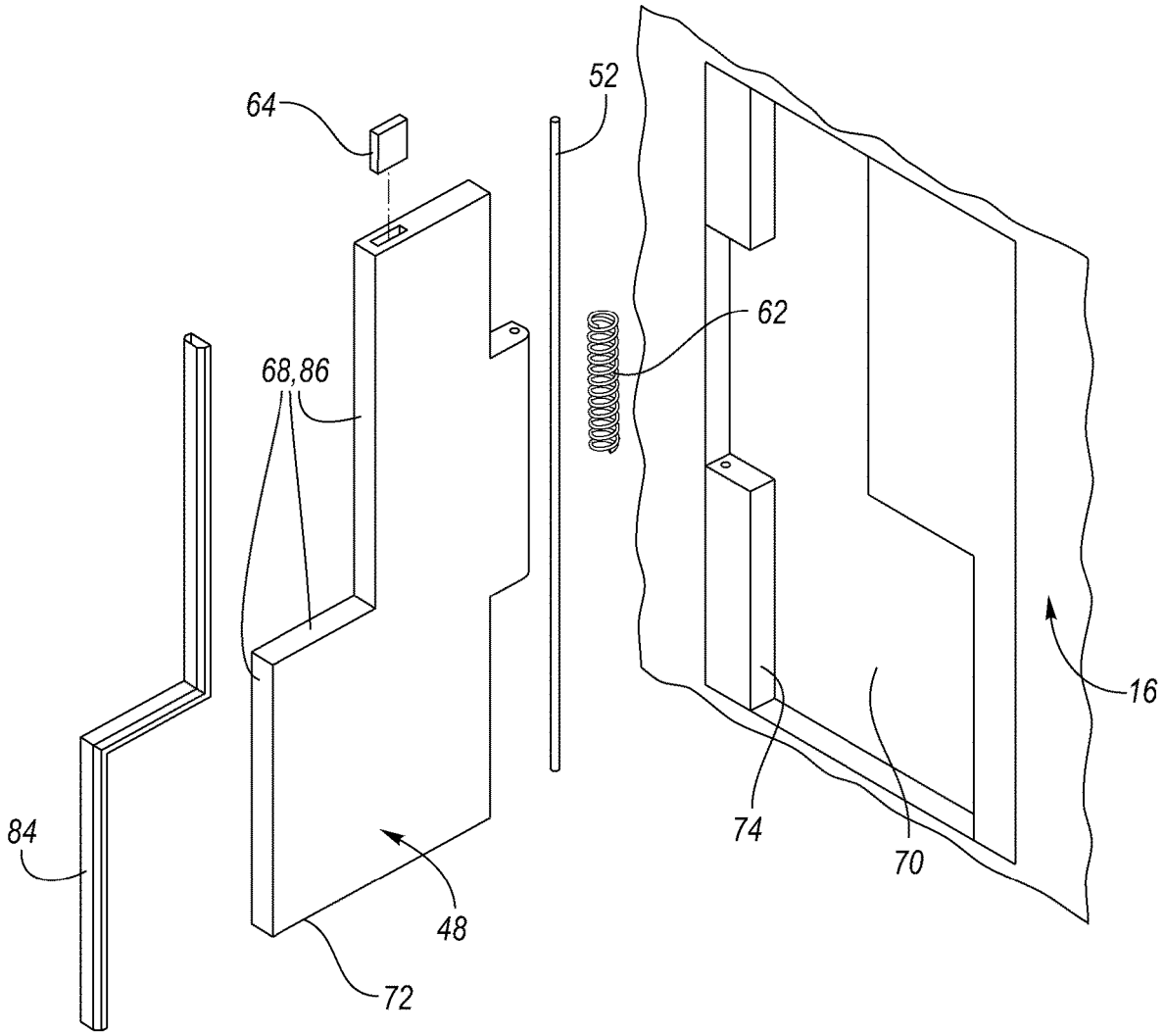
FIG. 5 is an exploded view of the divider and various components associated with the divider.

The divider 48 is configured to advance away from the door 16 (or more specifically away from the bottom 50 of the door 16) to transition to an operational position 54. More specifically, the divider 48 may be configured to rotate (e.g., via the one or more pivot pins 52) to transition to the operational position 54. The divider 48 is also configured to retract toward the door 16 (or more specifically toward the bottom 50 of the door 16) to transition to a stowed position 56. More specifically, the divider 48 may be configured to rotate (e.g., via the one or more pivot pins 52) to transition to the stowed position 56. The operational position 54 and the stowed position 56 may also be referred to as the advanced position and the retracted position, respectively. The operational position 54 and the stowed position 56 may alternatively be referred to as the first position and the second position, respectively, or vice versa. An intermediate position 57 that is between the operational position 54 and the stowed position 56 is illustrated in FIG. 4B.

The divider 48 is configured to advance away from the door 16, transition to the operational position 54, and engage the cabinet 12 (or more specially the front wall 18 of the cabinet 12) to separate the air inlet 38 from the air outlet 40 in response to closing the door 16 (i.e., transitioning the door 16 to the closed position 19) and while the door 16 remains in the closed position 19. Stated in other terms, the divider 48 may be rotated away from the door 16 (or more specifically away from the bottom 50 of the door 16) and to the operational position 54 to engage a lower end 58 of the cabinet 12 to separate the air inlet 38 from the air outlet 40 when the door is in the closed position 19. Segregating the air inlet 38 from the air outlet 40 via the divider 48 operates to prevent the air from the hot air exhaust flow path flowing out of the air outlet 40 from be directed into to the air inlet 38, which increases the efficiency of heat exchange within the machine compartment 22 for removing heat from the compressor 42 and condenser 44.

The divider 48 is also configured to retract toward the door 16, transition to the stowed position 56, and provide clearance within a space 60 that is defined between the door 16 and the cabinet 12 in response to opening the door 16 (i.e., transitioning the door 16 to the open position 17) and while the door 16 remains in the open position 17. Stated in other terms, the divider 48 may be rotated toward the door 16 (or more specifically toward the bottom 50 of the door 16) and to the stowed position 56 to provide clearance for a user within the space 60 that is defined between the door 16 and the cabinet 12 when the door 16 is in the open position 17. Providing such clearance is desirable because it prevents a user from accidently kicking or otherwise engaging the divider 48.

The divider 48 may be positioned to be substantially perpendicular to the door 16 when in the operational position 54. Substantially perpendicular may refer to any incremental angle that is between exactly perpendicular and 15° from exactly perpendicular. The divider 48 may be positioned to be substantially parallel to the door 16 when in the stowed position 56. Substantially parallel may refer to any incremental angle that is between exactly parallel and 15° from exactly parallel.

A spring 62 may be secured to the divider 48 and the door 16. The spring 62 may be configured to bias the divider 48 toward the stowed position 56. The spring 62 may be a torsional spring. A magnet 64 may be secured to the divider 48. More specifically, the magnet 64 may be secured to a top side or top edge of the divider 48. A magnetic force between the magnet 64 and the cabinet 12 (or more specifically the lower end 58 of the cabinet 12) operates to overcome a force of the spring 62 and transition the divider 48 to the operational position 54 in response to the divider 48 approaching cabinet 12 as the door 16 transitions to the closed position 19.

The cabinet 12 (or more specifically the lower end 58 of the cabinet 12) may have a stepped profile 66 along the air inlet 38 and air outlet 40. The divider 48 may include a corresponding stepped profile 68 that is configured to engage the stepped profile 66 of the cabinet 12 when the divider 48 is in the operational position 54 to properly segregate the air inlet 38 from the air outlet 40. The door 16 (or more specifically the bottom 50 of the door 16) may define a recess 70 configured to receive the divider 48 when the divider 48 is in the stowed position 56. The recess 70 may also include a stepped profile to receive the corresponding stepped profile 68 of the divider 48. Stated in other terms an outer boundary or periphery 72 of the divider 48 and an outer boundary or periphery 74 of the recess 70 may have matching profiles.

The door 16 may be part of a built-in system that includes a concealing panel 76 that is disposed along the exterior of the door 16. The concealing panel 76 may be integral to the door 16 or may be a separate component that is attached to the door 16. The concealing panel 76 may have a lower overhanging portion 78 the covers the lower end 58 of the cabinet 12, including the air inlet 38 and air outlet 40, to increase the aesthetics of the refrigerator 10. A space 80 is defined between an internal surface 82 of the concealing panel 76 and the lower end 58 of the cabinet 12. The internal surface 82 of the concealing panel 76 may more specifically define the recess 70. The concealing panel 76 may be secured to the exterior panel 28 of the door 16 or may be integral to exterior panel 28 of the door 16 as illustrated in FIG. 2. A gasket 84 is secured to a front edge 86 of the divider 48. The gasket 84 is configured to engage the cabinet 12 (or more specifically the lower end 58 of the cabinet 12) when the divider 48 is in the operation position 54 to create a seal between the divider and the front wall 18, which further enhances preventing air flowing from the air outlet 40 toward the air inlet 38.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator comprising:

a cabinet defining (i) a refrigerated compartment, (ii) a machine compartment below the refrigerated compartment, (iii) an inlet to the machine compartment, and (iv) an outlet from the machine compartment;

a door rotatably secured to the cabinet, (ii) configured to rotate to an open position to provide access to the refrigerated compartment, and (iii) configured to rotate to a closed position to cover the refrigerated compartment; and a divider (i) rotatably secured to a bottom of the door, (ii) configured to rotate to an advanced position in response to closing the door, and (iii) configured to rotate to a retracted position in response to opening the door, wherein (a) in the advanced position the divider is rotated away from the bottom of the door and engages a lower end of the cabinet to separate the inlet from the outlet and (b) in the retracted position the divider is rotated toward the bottom of the door to provide clearance for a user within a space that is defined between the door and the cabinet when the door is in the open position.

2. The refrigerator of claim 1, wherein the divider is (i) substantially perpendicular to the door in the advanced position and (ii) substantially parallel to the door in the retracted position.

3. The refrigerator of claim 1 further comprising a spring secured to the divider and the door, wherein the spring is configured to bias the divider toward the retracted position.

4. The refrigerator of claim 3 further comprising a magnet secured to the divider, wherein a magnetic force between the magnet and the lower end of the cabinet operates to overcome a force of the spring and transition the divider to the advanced position in response to the divider approaching the lower end of the cabinet as the door transitions to the closed position.

5. The refrigerator of claim 1 further comprising a gasket secured to a front edge of the divider, wherein the gasket is configured to engage the lower end of the cabinet when the divider is in the advanced position.

6. The refrigerator of claim 1, wherein (i) the lower end of the cabinet has a stepped profile along the inlet and outlet and (ii) the divider includes a corresponding stepped profile that is configured to engage the stepped profile of the cabinet when the divider is in the advanced position.

7. The refrigerator of claim 1, wherein the bottom of the door defines a recess configured to receive the divider when the divider is in the retracted position.

8. The refrigerator of claim 7, wherein an outer periphery of the divider and an outer periphery of the recess have matching profiles.

9. A refrigerator comprising:

a cabinet defining an air inlet and an air outlet;

a door (i) movably secured to the cabinet and (ii) configured to transition between open and closed positions; and a divider plate (i) movably secured to the door, (ii) configured to advance away from the door to transition to a first position, and (iii) configured to retract toward the door to transition to a second position, wherein (a) in response to closing the door, the divider plate advances away from the door, transitions to the first position, and engages the cabinet to separate the air inlet from the air outlet and (b) in response to opening the door, the divider plate retracts toward the door, transitions to the second position, and provides clearance within a space that is defined between the door and the cabinet when the door is in the open position.

10. The refrigerator of claim 9, wherein the divider plate is (i) substantially perpendicular to the door in the first position and (ii) substantially parallel to the door in the second position.

11. The refrigerator of claim 9 further comprising a spring secured to the divider plate and the door, wherein the spring is configured to bias the divider plate toward the second position.

12. The refrigerator of claim 9 further comprising a magnet secured to the divider plate, wherein a magnetic force between the magnet and the cabinet operates to transition the divider plate to the first position in response to the divider plate approaching the cabinet as the door transitions to the closed position.

13. The refrigerator of claim 9 further comprising a gasket secured to a front edge of the divider plate, wherein the gasket is configured to engage the cabinet when the divider plate is in the first position.

14. The refrigerator of claim 9, wherein the door defines a recess configured to receive the divider plate when the divider plate is in the second position.

15. A refrigerator comprising:

a cabinet defining an air inlet and an air outlet;

a door (i) movably secured to the cabinet and (ii) configured to transition between open and closed positions; and a partition (i) movably secured to the door, (ii) configured to advance away from the door to transition to an operational position that is substantially perpendicular to the door, and (iii) configured to retract toward the door to transition to a stowed position that is substantially parallel to the door, wherein (a) in response to closing the door, the partition transitions to the operational position and engages the cabinet to separate the air inlet from the air outlet and (b) in response to opening the door, the partition transitions to the stowed position and provides clearance within a space that is defined between the door and the cabinet when the door is in the open position.

16. The refrigerator of claim 15 further comprising a spring secured to the partition and the door, wherein the spring is configured to bias the partition toward the stowed position.

17. The refrigerator of claim 15 further comprising a magnet secured to the partition, wherein a magnetic force between the magnet and the cabinet operates to transition the partition to the operational position in response to the partition approaching the cabinet as the door transitions to the closed position.

18. The refrigerator of claim 15 further comprising a gasket secured to a front edge of the partition, wherein the gasket is configured to engage the cabinet when the partition is in the operational position.

19. The refrigerator of claim 15, wherein (i) the cabinet has a stepped profile along the air inlet and air outlet and (ii) the partition includes a corresponding stepped profile that is configured to engage the stepped profile of the cabinet when the partition is in the operational position.

20. The refrigerator of claim 15, wherein the door defines a recess configured to receive the partition when the partition is in the stowed position.

* * * * *